US005765256A

Jnited States Patent [19]

llan et al.

[11] Patent Number: 5,765,256

[45] Date of Patent: Jun. 16, 1998

4] NONWOVEN CLEANING BRUSH

5] Inventors: James M. Allan, Toronto, Canada; Barry A. Brandley, Warrimoo, Australia 3] Assignee: Minnesota Mining and Manufacturing Company, St. Paul, Minn.

1] Appl. No.: 591,602

2] PCT Filed: Aug. 15, 1994

5] PCT No.: PCT/US94/09228

§ 371 Date: Feb. 9, 1998

§ 102(e) Date: Feb. 9, 1996

7] PCT Pub. No.: WO95/05101

PCT Pub. Date: Feb. 23, 1995

0] Foreign Application Priority Data ug. 19, 1993 [AU] Australia ..... 44761/93

1] Int. Cl.[6] ..... B60B 7/04; B21B 31/08

2] U.S. Cl. ..... 15/230.12; 16/230; 29/395.213; 492/41; 492/59; 492/45; 156/300.3; 451/533

3] Field of Search ..... 15/230.14, 230.12, 15/230, 230.13, 230.17, 230.19, 179, 180, 181; 492/40, 41, 45, 57, 59, 28, 52; 29/895, 895.2, 895.21, 895.213; 156/290, 291, 295, 306.3; 451/526, 532, 533

5] References Cited

U.S. PATENT DOCUMENTS

| | | | |
|---|---|---|---|
| 2,186,679 | 1/1940 | Lade | 492/40 |
| 2,801,461 | 8/1957 | Kusters | 492/41 |
| 3,127,253 | 3/1964 | Smith | 15/230.13 |
| 3,853,677 | 12/1974 | Kai | 161/36 |
| 4,283,821 | 8/1981 | Paakkunainen | 492/28 |
| 4,475,275 | 10/1984 | Edwards | 29/895.213 |
| 4,578,847 | 4/1986 | Ahrewiler | 492/5 |
| 4,583,966 | 4/1986 | Ocker et al. | 493/374 |
| 4,604,778 | 8/1986 | Edwards | 492/40 |
| 4,669,163 | 6/1987 | Lux et al. | 492/41 |
| 4,893,439 | 1/1990 | McAvey et al. | 15/230.13 |
| 4,946,738 | 8/1990 | Chenoweth et al. | 422/284 |
| 5,038,448 | 8/1991 | Gusmer | 492/41 |
| 5,038,469 | 8/1991 | Masuda et al. | 29/895.213 |
| 5,082,720 | 1/1992 | Hayes | 428/224 |
| 5,127,123 | 7/1992 | Belanger | 15/230.14 |
| 5,327,601 | 7/1994 | Nakayama et al. | 451/342 |
| 5,400,460 | 3/1995 | Roeter et al. | 15/230.12 |
| 5,491,025 | 2/1996 | Pihl et al. | 428/373 |
| 5,626,512 | 5/1997 | Palaikis et al. | 15/209.1 |

FOREIGN PATENT DOCUMENTS

| | | |
|---|---|---|
| 0138556 | 4/1985 | European Pat. Off. . |
| 0227375 | 7/1987 | European Pat. Off. . |
| 59-24228 | 6/1984 | Japan . |
| 60-44421 | 10/1985 | Japan . |

*Primary Examiner*—Gary K. Graham

*Attorney, Agent, or Firm*—Gary L. Griswold; Walter N. Kirn, Jr.; Paul W. Busse

[57] ABSTRACT

A brush made from a nonwoven, thermally bonded bicomponent fiber web is described. The nonwoven brush of the invention includes a plurality of compressed annular sections assembled about a central carrier with each section made of a mat of bicomponent fibers which have been crimped and melt bonded. In a preferred embodiment, the brush will have a compacted density of between about 50 and about 250 kilograms per cubic meter. The fibers making up the compressed annular sections are preferably a combination of polyolefins (e.g. polypropylene and polyethylene) but may also include polyesters and other materials.

18 Claims, 2 Drawing Sheets

NONWOVEN CLEANING BRUSH

TECHNICAL FIELD

The present invention relates to a nonwoven thermally bonded fiber compressed brush construction suitable for use in caustic mill environments such as in steel strip mills, for example. More specifically, the invention relates to a brush for use in caustic environments wherein the brush is made from a plurality of compressed annular sections made of bicomponent nonwoven fibers. The brushes of the present invention are made of fibers that can withstand extremely caustic environments without requiring resinous coatings, binders or the like.

BACKGROUND ART

Prior to electrolytic tin plating, steel strip must be thoroughly cleaned. This is done on a continuous basis in steel strip mills by passing the strip through a hot caustic cleaning tank and then through hot water rinse tanks. Brushes are commonly used in the cleaning process to agitate the surfaces of the steel strip.

Historically, the aforementioned brushes have been made from any of a variety of materials. Until recently, bristled brushes were commonly used in the cleaning process and typically had natural vegetable fiber bristles. For example, brushes having tampico bristles made from a coarse grass-like plant grown in the region around Tampico, Mexico (hereinafter "tampico bristled brushes") had enjoyed widespread use in steel strip cleaning applications. Bristled brushes may also include bristles of a synthetic construction such as; polypropylene, for example. Bristled brushes, however, experienced a short service life in the caustic environment of steel strip mills.

About ten years ago, a cleaning brush made of a compressed body formed of a multiplicity of ganged segments of nylon nonwoven web fabric was developed and sold in Australia by the assignee's subsidiary company, 3M Australia. These brushes were found to have an effective service life two to three times that of the tampico bristled brushes. The Australian brush is made from an air laid randomly formed web of 13 to 15 denier nylon staple of length 38 millimeters. The nylon web is needletacked to increase its density and strength, and the web is thoroughly impregnated with a phenolic resin solution as a binder which, when cured, provides the web with some resistance to highly caustic conditions. This type of brush construction has been utilized for about the last ten years.

However, the phenolic bonded nylon web brush has also exhibited some shortcomings in the caustic environments in which it has been used. Although it generally enjoyed a much longer useful life than the tampico bristled brushes, the nylon web brushes are known to degrade and generate waste or "fluff" as a result of the gradual breakdown under hot caustic conditions (typically pH 13 and 80° C.) of the protective phenolic resin binder coating the nylon fibers. The fluff is caused by the release of the nylon staple fibers. The generation of fluff is problematic because it is difficult to clean out of the steel mill cleaning lines and it tends to block filters.

Because of the noted problems with cleaning brushes, there is a need for an improved cleaning brush for use in the caustic environments of steel strip mills and the like. Moreover, there is a need for a cleaning brush which has an improved resistance to caustic solutions to thereby avoid the aforementioned degradation of the phenolic resin material and the resulting fluff caused by the destruction of the brush fibers in the caustic environment.

DISCLOSURE OF INVENTION

The present invention overcomes the noted problems in the art by providing a rotary brush suitable for use in cleaning steel strip rolls and the like in caustic environments, the brush comprising:

a cylindrical body rotatable about its longitudinal axis, said body comprising a compressed stack formed of a plurality of like-oriented annular sections, each section assembled about a central carrier, the sections each comprising a nonwoven web of crimped bi-component fibers comprised of a first polymer component and a second polymer component having a melting temperature lower than the melting temperature of said first polymer component, said first polymer component and said second polymer component attached to one another within each section by melt bonding, said body having a density of between about 50 and about 250 kg/m$^3$.

The fibers making up the compressed annular sections are preferably a combination of polyolefins (e.g. polypropylene and polyethylene) but may also include polyesters and other materials. The annular sections are preferably needle tacked prior to melt bonding. Spacers may be interposed between the annular sections so that the finished brush will include a plurality of annular sections and spacers in a predetermined ratio.

A preferred method of manufacturing the rotary brushes of the present invention comprises:

preparing an air laid web of crimped bicomponent fibers comprising a first polymer component and a second polymer component having a melting temperature lower than the melting temperature of said first polymer component; bonding said first and second polymer components to one another within said web by heating said web to a temperature sufficient to soften said second polymer component and cause melt bonding between said polymer components within said web; preparing a plurality of annular sections from said nonwoven web; orienting said plurality of annular sections for rotation about a common axis; compressing said plurality of sections along said common axis with a force sufficient to achieve a compacted configuration of said sections having a density of between about 50 and about 250 kg/m$^3$; and restraining said annular sections in said compacted configuration.

Those skilled in the art will more fully understand the details of the invention upon consideration of the remainder of the disclosure including the detailed description of the preferred embodiments and the appended claims.

BRIEF DESCRIPTION OF DRAWINGS

In describing the preferred embodiments of the invention, reference is made to the various figures wherein:

FIG. 1(*b*) is a plan view of a surface of a spacer suitable for inclusion in a rotary brush body according to a first embodiment of the present invention;

FIG. 1(*c*) is an exploded view of the elements of a rotary brush body according to a first embodiment of the invention;

FIG. 1(*d*) is a perspective view of a completed rotary brush body according to a first embodiment of the invention;

FIG. 2(*b*) is a plan view of a surface of a spacer suitable for use in a rotary brush body according to a second embodiment of the invention;

FIG. 2(*c*) is an exploded view of the elements of a rotary brush according to a second embodiment of the invention; and FIG. 2(*d*) is a perspective view of the completed rotary brush according to the second embodiment of the invention.

DETAILED DESCRIPTION

Figure 1A:
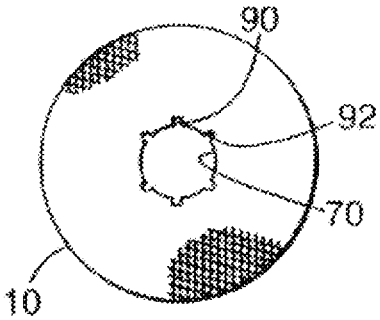
FIG. 1(*a*) is a plan view of one surface of an annular section of a nonwoven web suitable for inclusion in a rotary brush body according to a first embodiment of the present invention.
Figure 1B:
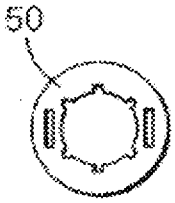

Details of the preferred embodiments of the invention are now to be described in some detail. It will be understood by those skilled in the art that the structural details of these embodiments are not limiting in any way but are merely illustrative of the features of the invention. In describing the preferred embodiments, reference is made to the various figures wherein the structural features of the invention are identified by reference numerals and wherein identical reference numerals indicate identical structures.

Referring to the various figures, FIGS. 1 and 2 illustrate, respectively, first and second embodiments of a compressed cleaning brush made of a nonwoven thermally bonded fiber web. FIGS. 1(*a*)–(*d*) show various features of a first embodiment of the invention, showing the brush 30 and its components in a tie-bolt construction. FIGS. 2(*a*)–(*d*) illustrate another embodiment of the invention showing the same brush material utilized in a bonded brush construction 40. In one aspect of the invention, the web includes no phenolic resin binders. As those skilled in the art will appreciate, it is also conceivable that the brushes described herein could be made into a flap brush type construction as well as the compressed section type. It will also be appreciated that the spacers described herein may not be essential in certain type brushes such as smaller brushes, for example.

In both of the embodiments described herein, a nonwoven web is used to prepare the annular sections 10 and 20. In the web, it is preferred that bicomponent fibers be used without additional resins (e.g. phenolic resins) or the like to either protect or bind the fibers of the web. Preferred web fibers include certain polymer fibers such as polyolefin fibers, polyester fibers and combinations thereof. More preferably, polyolefin bicomponent fibers are used and most preferably polyethylene and polypropylene crimped staple fibers. In order to achieve a satisfactory brush construction which is resistant to physical damage in the caustic environments in which it will be used while achieving a desired cleaning effect, the fiber diameter can be important. Polyolefin fibers in deniers from about 3 to about 40 denier are preferred. The fiber length can range from being virtually continuous to being of finite length. Crimped polyolefin staple fibers having lengths from about 25 millimeters to about 64 millimeters and more preferably from about 38 to about 50 millimeters have been useful in preparing webs using conventional web forming equipment. The fibers may be only slightly crimped and the nature of the fiber crimp includes conjugate or helical crimps. Typically the fibers are thermoplastic bi-component, i.e. sheath and core type or side-by-side type, one component preferably being polypropylene and the other preferably polyethylene. It is also contemplated that polyester bicomponent fibers may be used.

The preferred construction of the web includes no additional resinous materials to bond or protect the fibers of the web. An important aspect of the invention is the manufacture of a bicomponent web wherein the fibers are melt bonded to one another at the fiber contact points within the web. In webs made from the above mentioned preferred combination of polyolefins, for example, the web is typically heated to the temperature of the lower melting point polyethylene component while the higher melting point polypropylene component maintains its dimensions during the heating step. During this heating step, the melted polyethylene fibers bond with the polypropylene at the contact points of the fibers within the web and the web experiences only minimal shrinkage during bonding. Preferred webs for the brush construction are those made in web basis weights from about 100 grams per square meter ("gsm") to about 500 gsm and those having a web thickness of from about 5 millimeters to about 25 millimeters. The above described nonwoven webs may be manufactured in a known manner by using a RANDO WEBBER brand machine (Rando Machine Corporation, Macedon, N.Y.) or a FIBER LOCKER brand machine (James Hunter, North Adams, Mass.).

For additional web strength (i.e. tensile and tear strengths) a needle punching or needle tacking operation performed on the web before melt bonding has been found to be advantageous. Needle tacking is a known technique which uses barbed or felting needles to further entangle the fibers of a nonwoven web by forcing the needles into the web in a predetermined manner. Where needle tacking has been employed, satisfactory webs have been achieved by using a needle tacker machine fitted with a multiplicity of needles, typically 15×18×30×3.5 CB Foster felting needles fitted to the needle board. One preferred needle bar layout includes five rows spaced apart at distances of 8.5 mm, 8.5 mm, 10 mm and 6.5 mm and with the needles in each row evenly spaced at a distance of 12.5 mm.

After punching, the web is transported by conveyors through a preheated oven. A 25 meter long, center fed (e.g. counter current air flow towards the web inlet end and concurrent towards the exit) oven which is gas fired with an air flow at its inlet duct of about 8000 cubic feet/minute (227 cubic meters/minute) and about 4000 cfm at the exit ducts (113 cubic meters/minute) has been used with satisfactory results. Air flow is deflected through the web with angled baffles above and below a carrier mesh belt and the web is heated to the softening or melting temperature of one of the component fibers. Where polypropylene/polyethylene fibers are used, the web is heated to a temperature from about 142° C. to about 148° C. to induce heat fusion of the fibers. Those in the art will appreciate that the temperature of the oven may be varied over a range of temperatures depending upon the weight of the web and the speed at which the web is fed through the oven. It has been found that satisfactory webs are produced by feeding the nonbonded web material having a weight of about 200 gsm at a line speed of four meters per minute through a 25 meter long oven maintained at a temperature of about 142° C. As the weight of the web and/or the speed at which it is carried though the oven increases, the temperature of the oven must also be increased. A 250 gsm web, for example, has been adequately bonded at a temperature of about 148° C. when conveyed through the oven at a conveyor speed of five meters per minute.

The bonded web is cooled on exiting the oven with an air knife and passed through a dancing nip roller from which it enters a festoon accumulator prior to being wound onto a master roll or "jumbo". Annular sections 10, 20 are then punched from the manufactured web. The sections 10, 20 are punched from the web in a variety of diameters which will typically vary between about 200 millimeters and about 600 millimeters, depending on brush requirements as well as the available physical space in the cleaning line(s) where the finished brush is to be installed. It will be appreciated that the invention does not require any real limit to the web diameter or to the brush length other than what might be imposed by engineering design considerations.

The web sections 10, 20 are formed with center apertures 70, 80 which may include opposing squared-off keyway slots 90 (FIG. 1*a*) to fit over a key element on a support shaft. Additional slots 92 may be provided to engage long tie-bolts (or axle bolts) 100 which hold the brush components together during the assembly process. Where a glued brush construction is required, tie bolts 100 are not used and the sections 20 and spacers 50 are adhered to a steel core 110 as shown in FIGS. 2(*a*)–(*d*), for example.

Spacers 50, 60 are provided for positioning between web sections. The spacers 50, 60 are typically made from a thermoplastic material such as polypropylene, and are provided with a center hole configuration similar (and usually identical) to the apertures 70, 80 of the webs 10, 20. As shown, the spacers are provided with a smaller outer diameter than the annular sections 10 and 20. The spacers are positioned between annular sections along an assembly shaft such as the axle bolts 100 in a predetermined number of spacers per finished brush and at a predetermined number of annular sections per spacer. The section to spacer ratio in the brushes of FIGS. 1 and 2, for example, is 3:1 and the loading of annular sections is typically 12.5 sections per 25 millimeters of brush length. Those skilled in the art will appreciate that this brush loading and the section to spacer ratio is not limiting in any way. It is contemplated that preferred brush loadings could range between about 5 and about 20 sections per 25 millimeters and the preferred section to spacer ratios could range from about 1:0 to about 5:1. The use of spacers 50, 60 within the construction of the brushes disclosed herein is generally desired because the spacers allow the annular web sections 10, 20 in the finished brush some freedom to move laterally at their peripheral portions for proper cleaning operations while also firmly reinforcing the annular sections 10, 20 along their inner diameters. Spacers made of polypropylene having an outer diameter of 200 millimeters, an inner diameter of 109 mm and a thickness of 1.9 mm have been satisfactory.

Figure 1C:
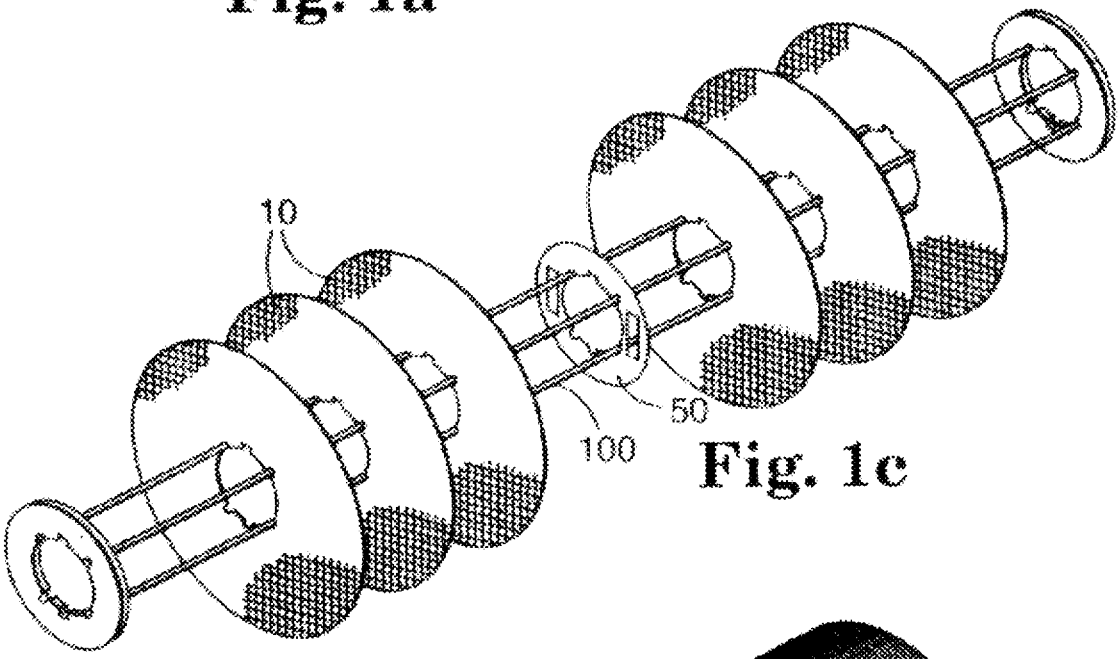
Figure 1D:
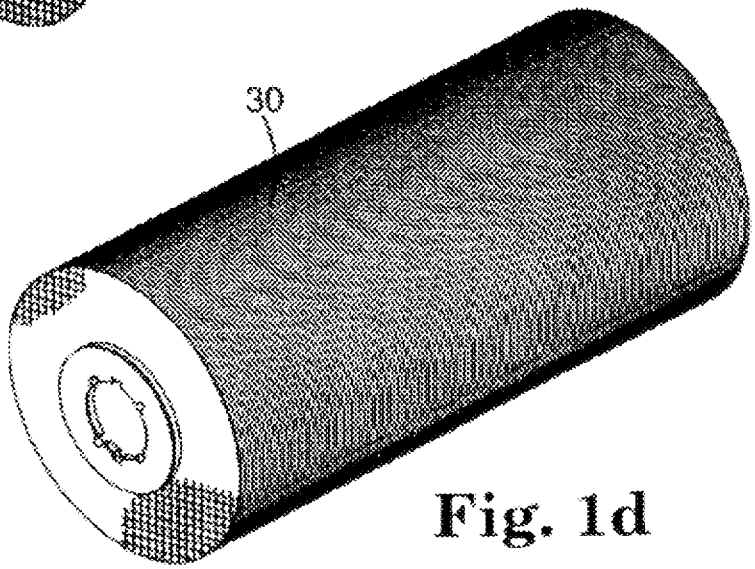
Figure 2A:
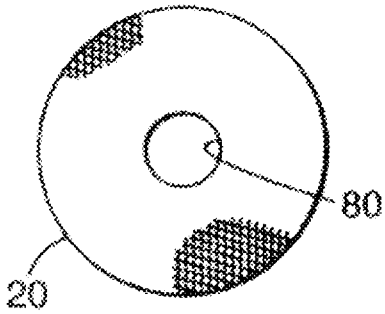
FIG. 2(*a*) is a plan view of an annular section of a nonwoven web suitable for inclusion in a rotary brush body construction according to a second embodiment of the invention.
Figure 2B:
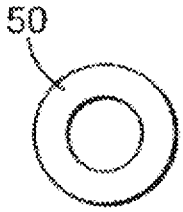
Figure 2C:
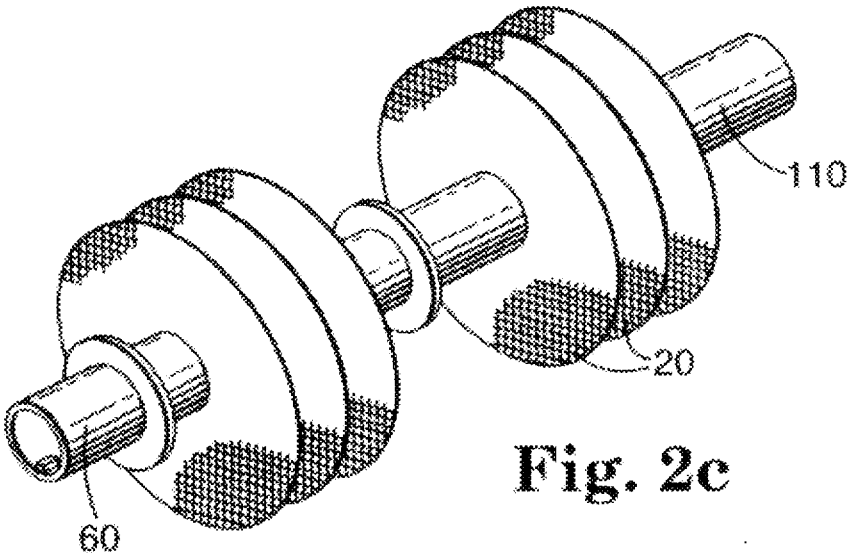
Figure 2D:
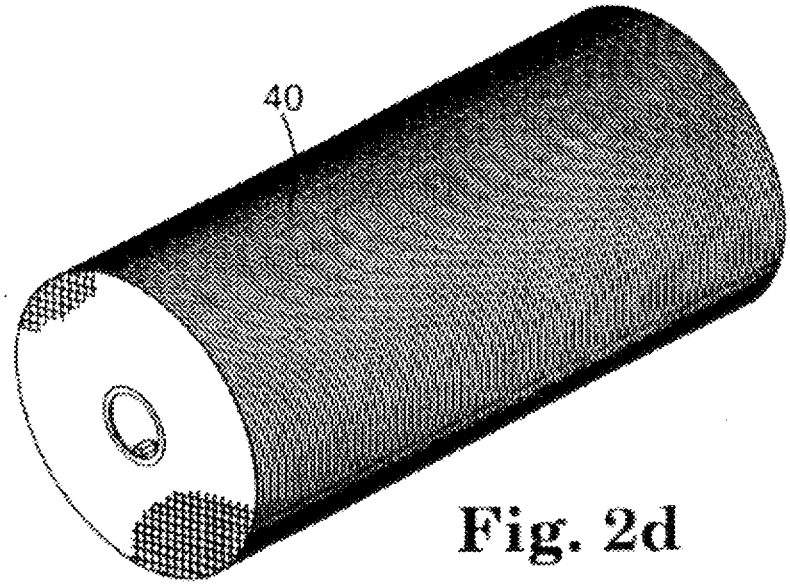

In the embodiment of FIG. 1*c* and 1*d*, the annular sections 10 and the spacers 50 are assembled along the axle bolts 100 between end flanges 120. In the embodiment of FIG. 2*c* and 2*d*, the sections 20 and the spacers 150 are positioned along the core 60. After a predetermined number of spacers and annular sections have been assembled as described above, the spacers and the annular sections are compressed under a sufficient force at room temperature to make a dense nonwoven brush structure of a predetermined length which can then be loaded onto working shafts (not shown) for cleaning operations in steel mills. The compacted densities of the brushes of the present invention are preferably at least about 5 kg/m$^3$ and more preferably between about 50 and about 250 kg/m$^3$ and most preferably about 125 kg/m$^3$. The compaction force may be applied by any suitable means available to those in the art. Once the desired compacted density has been attained, the annular sections and the spacers are then restrained in their compacted configuration by any suitable means such as the end flanges 120 or locking collars adapted to be slidable on and mechanically engagable with the axle bolts 100. Similarly, the sections 20 and the spacers 150 of FIG. 2 may be held on the core 60 by adhesive bonding. The preferred hardness of the finished brushes as measured by the Shore A2 scale is between about 5 and about 25.

In a preferred construction of the present invention, the web is made from a side-by-side bi-component polyethylene/polypropylene staple fiber supplied by Chisso Corporation (Polypropylene Fiber Division, 6-32 Naanoshima 3, Kita-Ku, Osaka 530, Japan) and termed Chisso Type ES. The preferred staple fiber is 18 denier and length 64 millimeters. The preferred web weight is 250 gsm. The web may be needle punched at a punch density of about 8 punches/cm$^2$by needletacking at 760 cycles/min and with a penetration of 21 millimeters into the web at a line speed of four meters per minute. Where lines speeds are increased to five meters per minute, for example, the tacker rate should be increased to about 950 cycles/min. Other line speeds may require further adjustments which are within the skill of those practicing in the field. A preferred brush construction 30, 40 includes about 600 annular sections and about 200 polypropylene spacers 50, 60, each about 1.9 millimeters thick to form a 1.2 meter long × 406 millimeters diameter compressed brush.

It has been found that when the brush of the present invention is run in the same hot caustic application as the conventional nylon/phenolic bonded brush, the brush of the present invention exhibited an extended life about 70% greater than the nylon/phenolic brush. The brush of the invention has also been observed to generate reduced "fluff" or waste during normal use in caustic environments. These results reflect a life extension of about 350% along with a significant reduction in mill maintenance when compared with the tampico bristled brushes discussed above.

The following example is illustrative of the manufacture, construction and the durability of a preferred embodiment of the nonwoven brushes of the invention.

EXAMPLE

A 250 g/m$^2$, 50 mm thick nonwoven fabric is prepared by processing "CHISSO" polyethylene/polypropylene sheath/core staple fiber (Chisso Corporation, Osaka, Japan or Chisso America, Inc., New York, N.Y.), 18 denier × 38 mm length using an air lay machine available under the trade designation "RANDO WEBBER" from Rando Machine Corporation, Macedon, N.Y. The resulting fabric is consolidated by needle tacking using a conventional needletacker with a needle board loaded to 10 needles per inch (3.9 per cm) with needles designated 15×18×30×3.5 CB, available from Foster Needle Company, Manitowoc, Wis.. The needle tacker is adjusted to provide 85 mm needle penetration and 49 penetrations/in$^2$ (7.6 penetrations/cm$^2$). The thus consolidated fabric is passed at 5 m/min. through a 25 meter long forced-draft bonding oven heated to 148° C. The resulting fabric is about 10 mm thick, is well bonded and relatively stiff, and has no fluffy appearance.

Annular sections of three different diameters are then cut from the consolidated and bonded fabric. The majority of the sections are cut to provide an outer diameter ("o.d.") of 406 mm and an inner diameter ("i.d.") of 109 mm, the i.d. further provided with 4 equiangularly spaced notches to accept an array of 4 axle bolts, and two symmetrical notches to provide a keyway for mounting on an end use shaft. Lesser numbers of sections are cut having outside diameters of 300 mm and 255 mm, all with an inside diameter of 109 mm and with the same array of notches an in the 406 mm sections. The two smaller o.d. sections are used to provide tapered or stepped ends for the final brush. Polypropylene spacers of 200 mm o.d., 109 mm i.d., and thickness of 1.9 mm are cut from polypropylene sheet, also providing the notches to accommodate the axle bolts and shaft keys. Having provided these various sections and the spacers, the cleaning brush of the present invention is now ready for assembly.

Four axle bolts are secured to an end flange in an equiangular array identical to that of the axle bolt notches provided in the sections and spacers. The end flange is also provided with two opposing keyway notches, likewise matching those provided in the sections and spacers. Four 255 mm o.d. annular sections are placed over the axle bolts so that the axle bolts engage the axle bolt notches. A spacer is then placed similarly over the axles bolts, followed by two 300 mm o.d. sections, followed by a spacer, then followed by two 406 mm o.d. sections and subsequently a spacer. This assembly is continued by alternating three 406 mm o.d. sections followed by a spacer until about 250 sections are loaded on the axle bolts. The assembly of sections and spacers is then compressed under a force of about 850 psi (5.9 MPa) and retained by a clamp assembly. This entire loading procedure is then repeated with three 406 mm o.d. sections followed by a spacer until about 600 sections are loaded. The assembly is completed by loading a spacer, two 300 mm o.d. sections, a spacer, four 255 mm o.d. sections, and finally, another end flange. The entire assembly is then compressed under a force of about 850 psi (5.9 MPa) and the end flange is secured. The resulting cleaning brush is 1.2 meters in length.

The cleaning brush is mounted on a keyed shaft and can then be evaluated as a cleaning brush in a plating operation where it is subjected to a heated (80° C.) cleaning solution which is highly caustic, typically having a pH of about 13. The brush will perform the cleaning operation adequately, generating virtually no fluff, and will have a useful life of nearly twice that of a conventional nylon/resin brush.

Although preferred embodiments of the invention have been discussed and described in some detail above, those skilled in the art will appreciate that various changes and modifications can be made to the described embodiments without departing from the true spirit and scope of the invention, as defined in the following claims.

We claim:

1. A method for preparing a rotary brush for cleaning operations, comprising:

preparing an air laid nonwoven web of crimped bicomponent fibers comprising a first polymer component and a second polymer component having a melting temperature lower than the melting temperature of said first polymer component;

bonding said first and second polymer components within said web to one another by heating said web to a temperature sufficient to soften said second polymer component and cause melt bonding between said polymer components within said web;

preparing a plurality of annular sections from said nonwoven web;

orienting said plurality of annular sections for rotation about a common axis;

compressing said plurality of sections along said axis with a compaction force sufficient to achieve a compacted configuration of said sections having a density of between about 50 and about 250 kg/m$^3$; and restraining said annular sections in said compacted configuration.

2. The method defined in claim 1 wherein the preparing of said air laid web is accomplished using fibers selected from the group consisting essentially of polyolefins, polyesters and combinations thereof.

3. The method defined in claim 1 wherein the preparing of said air laid web is accomplished using polypropylene as said first polymer component and polyethylene as said second polymer component.

4. The method defined in claim 3 wherein said bonding step is accomplished by heating said web to a temperature within a range of about 142° C. and about 148° C.

5. The method defined in claim 4 wherein said bonding step is accomplished by passing said web at a rate of about 5 meters/minute through a forced draft bonding oven heated to about 148° C.

6. The method defined in claim 1 wherein the preparing of a plurality of annular sections is accomplished by punch cutting annular shapes having a variety of sizes from said web, each of said annular sections prepared to include a central aperture dimensioned to receive a shaft therein.

7. The method defined in claim 1 wherein said compressing of said plurality of said sections comprises applying a compressive force to said sections of about 850 MPa.

8. The method defined in claim 7 wherein the density of said sections after said compressing thereof is about 125 kg/m$^3$.

9. The method defined in claim 1 said orienting of said sections includes aligning a predetermined number of said annular sections along said common axis together with a predetermined number of annular spacers, said spacers aligned along said common axis between adjacent annular sections such that the annular section to spacer ratio in the rotary brush is from about 1:0 to about 5:1.

10. The method defined in claim 1 further comprising needletacking said web prior to said bonding thereof, said needletacking carried out using a needle board loaded to a density of 3.9 needles per centimeter.

11. The method defined in claim 10 wherein said needletacking is accomplished with needle penetrations into said web of about 7.6 penetrations/cm$^2$ and with the needles on said needle board penetrating about 85 mm into said web.

12. A rotary brush comprising a rotatable, cylindrical body having a periphery adapted to provide some lateral movement about its longitudinal axis formed of a plurality of sections of a nonwoven web and a plurality of spacers interposed between sections of the nonwoven web, wherein the nonwoven web sections and spacers are compressed to a density of between about 50–250 kg/m$^3$, wherein the sections of nonwoven web comprise melt bonded, crimped bi-component fibers consisting essentially of a first polymer component and a second polymer component wherein the second polymer component has a lower melting temperature than the melting temperature of the first polymer component.

13. The rotary brush according to claim 12 wherein a least one of the nonwoven web sections is needletacked.

14. The rotary brush according to claim 12 wherein the crimped, bi-component fibers are side-by side crimped bi-component fibers having a denier of about 3–40.

15. The rotary brush according to claim 12 wherein the first and second polymer components are selected from the group consisting essentially of polyolefins, polyesters and combinations thereof.

16. The rotary brush according to claim 15 wherein the first polymer component is polypropylene and the second polymer component is polyethylene.

17. The rotary brush according to claim 12 wherein the nonwoven web sections have a basis weight of about 100–500 gsm.

18. The rotary brush according to claim 12 wherein the ratio of sections of nonwoven web to spacers within the cylindrical body is from about 1:0 to about 5:1.

* * * * *